US010988358B2

(12) United States Patent
Taylor et al.

(10) Patent No.: US 10,988,358 B2
(45) Date of Patent: Apr. 27, 2021

(54) HYDRAULIC SYNCHRONIZER

(71) Applicant: Vehicle Service Group, LLC, Madison, IN (US)

(72) Inventors: Steven H. Taylor, Hanover, IN (US); Brian E. Kelley, Madison, IN (US); Kevin S. Katerberg, Madison, IN (US); Austin Deuerling, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 116 days.

(21) Appl. No.: 16/139,758

(22) Filed: Sep. 24, 2018

(65) Prior Publication Data

US 2019/0023543 A1 Jan. 24, 2019

Related U.S. Application Data

(63) Continuation of application No. 14/885,309, filed on Oct. 16, 2015, now Pat. No. 10,081,522.

(Continued)

(51) Int. Cl.

*B66F 3/24* (2006.01)
*B66F 7/06* (2006.01)

(Continued)

(52) U.S. Cl.

CPC ..... *B66F 3/24* (2013.01); *B66F 3/46* (2013.01); *B66F 7/0666* (2013.01); *B66F 7/08* (2013.01);

(Continued)

(58) Field of Classification Search

CPC .... F15B 2211/41572; F15B 2211/7107; F15B 2211/782

See application file for complete search history.

(56) References Cited

U.S. PATENT DOCUMENTS 2,693,284 A 11/1954 Gerhardt
2,696,969 A 12/1954 Branick (Continued)

FOREIGN PATENT DOCUMENTS

DE 1920184 A1 11/1969
DE 29916254 U1 3/2000

(Continued)

OTHER PUBLICATIONS

International Search Report and Written Opinion dated Feb. 10, 2016 for International Application No. PCT/US2015/056068, 19 pages.

(Continued)

*Primary Examiner* — Joseph J Hail
*Assistant Examiner* — J Stephen Taylor
(74) *Attorney, Agent, or Firm* — Frost Brown Todd LLC

(57) ABSTRACT

An apparatus includes a housing, a piston, an input cavity, a first actuating shaft, a first output cavity, and a second output cavity. The housing comprises an input port, a first output port, a second output port, a first end, a second end, a first wide wall having a first internal surface, and a chamber at least partially defined by the first end and the first internal surface. The piston is able to actuate along the first internal surface of the first side wall. The input cavity is in fluid communication with the input port. The first output cavity is in fluid communication with the first output port. The second output cavity is in fluid communication with the second output port. The first actuating shaft is fixed to the piston and helps fluidly isolate the first output port from the second output port.

16 Claims, 13 Drawing Sheets

Related U.S. Application Data

(60) Provisional application No. 62/065,082, filed on Oct. 17, 2014.

(51) Int. Cl.
*B66F 7/08* (2006.01)
*B66F 3/46* (2006.01)
*F15B 11/16* (2006.01)

(52) U.S. Cl.
CPC ..... *F15B 11/16* (2013.01); *F15B 2211/405* (2013.01); *F15B 2211/41572* (2013.01); *F15B 2211/7107* (2013.01); *F15B 2211/782* (2013.01)

(56) References Cited

U.S. PATENT DOCUMENTS

| | | | | |
|---|---|---|---|---|
| 2,983,256 | A | 5/1962 | Seeloff | |
| 3,039,439 | A * | 6/1962 | Murek | F15B 11/036 91/25 |
| 3,288,036 | A | 11/1966 | Fisher | |
| 3,584,498 | A | 6/1971 | Beche | |
| 4,130,178 | A | 12/1978 | Smith, Jr. | |
| 4,612,847 | A | 9/1986 | Bouvet et al. | |
| 4,614,251 | A | 9/1986 | Hawkins | |
| 4,686,828 | A | 8/1987 | Rosman | |
| 4,831,915 | A | 5/1989 | Roach | |
| 5,012,898 | A | 5/1991 | Tsymberov | |
| 5,065,844 | A * | 11/1991 | Hon | B66B 9/04 187/275 |
| 5,887,430 | A | 3/1999 | Hirai et al. | |
| 6,321,634 | B1 * | 11/2001 | Yeo | B66F 7/20 91/459 |
| 7,322,190 | B2 | 1/2008 | Bair | |
| 7,603,942 | B1 | 10/2009 | Hanser et al. | |
| 7,685,927 | B1 | 3/2010 | Hanser et al. | |
| 8,905,378 | B2 | 12/2014 | Kern et al. | |
| 9,476,435 | B2 | 10/2016 | Yamaguchi et al. | |
| 10,081,522 | B2 | 9/2018 | Taylor et al. | |
| 2002/0170785 | A1 * | 11/2002 | Stockmann | B60P 1/4471 187/275 |
| 2004/0020197 | A1 * | 2/2004 | Cray | F15B 11/22 60/485 |
| 2006/0151252 | A1 | 7/2006 | Joos | |
| 2009/0242333 | A1 | 10/2009 | Finkbeiner | |
| 2010/0199653 | A1 | 8/2010 | Webster et al. | |
| 2013/0240300 | A1 * | 9/2013 | Fagan | B66F 7/10 187/210 |
| 2015/0144325 | A1 | 5/2015 | Heidecke et al. | |
| 2015/0329336 | A1 * | 11/2015 | Brown | B66F 7/04 254/89 H |

FOREIGN PATENT DOCUMENTS

| | | | |
|---|---|---|---|
| EP | 0141106 | A2 | 5/1985 |
| JP | 2002-255499 | A | 9/2002 |
| JP | 3764236 | B2 | 4/2006 |
| JP | 3795581 | B2 | 7/2006 |
| TW | 201118031 | A | 6/2011 |
| WO | WO 1986/005243 | A1 | 9/1986 |

OTHER PUBLICATIONS

European Search Report and Written Opinion dated Sep. 13, 2018 for Application No. 15850204.7, 3 pages.
Extended European Search Report dated Oct. 12, 2020 for Application No. 20180245.1, 10 pages.
Extended European Search Report dated Oct. 8, 2020 for Application No. 20180232.9, 9 pages.

* cited by examiner

HYDRAULIC SYNCHRONIZER

REFERENCE TO RELATED APPLICATIONS

This application claims priority to and is a continuation of U.S. patent application Ser. No. 14/885,309, filed Oct. 16, 2015, which is a nonprovisional of U.S. Provisional Patent Application No. 62/065,082, filed on Oct. 17, 2014, each entitled "Hydraulic Synchronizer."

BACKGROUND

A vehicle lift is a device operable to lift a vehicle such as a car, truck, bus, etc. Some vehicle lifts operate by positioning two or more scissor lift assemblies at, or near, a shop floor level. The vehicle may be then driven or rolled into position above the two scissor lift assemblies, while the scissor lift assemblies are in a retracted position. The scissor lift assemblies may be actuated to extend the height of the scissor lift assemblies, thus raising the vehicle to a desired height. Where two scissor lift assemblies are utilized, the scissor lift assemblies may be positioned at a central location relative to the vehicle's body such that the vehicle may balance on the scissor lift assemblies (e.g., under each axle). Afterward, once the user has completed his or her task requiring the vehicle lift, the vehicle may then be lowered. In some instances, the scissor lift assemblies may be equipped with a hydraulic cylinder or other similar device to actuate the scissor lift assemblies. In such instances, actuating two or more hydraulic cylinders with a single hydraulic pump may lead to the pressure of hydraulic fluid in one or more of the hydraulic cylinders to become unbalanced. Such an imbalance of hydraulic fluid may lead to the scissor lift assemblies extending at differing rates, thus forcing the vehicle out of balance as it is raised to the desired height. In other instances, such as where two hydraulic cylinders are used in a single scissor lift assembly or another type of vehicle lift, an imbalance in hydraulic fluid pressure between two hydraulic cylinders may cause certain moving parts of the vehicle lift to bind, wear unevenly, distort, etc. Thus, it may be desirable to balance the pressure of hydraulic fluid delivered to each hydraulic cylinder when multiple hydraulic cylinders are used to actuate the vehicle lift.

Examples of vehicle lift devices and related concepts are disclosed in U.S. Pat. No. 6,983,196, entitled "Electronically Controlled Vehicle Lift and Vehicle Services System," issued Jan. 3, 2006; U.S. Pat. No. 6,763,916, entitled "Method and Apparatus for Synchronizing a Vehicle Lift," issued Jul. 20, 2004; U.S. Pat. No. 6,601,430, entitled "Jack with Elevatable Platform," issued Aug. 5, 2003; U.S. Pat. No. 6,484,554, entitled "Portable Lift and Straightening Platform," issued Nov. 26, 2002; U.S. Pat. No. 6,269,676, entitled "Portable Lift and Straightening Platform," issued Aug. 7, 2001; U.S. Pat. No. 6,059,263, entitled "Automotive Alignment Lift," issued May 9, 2000; U.S. Pat. No. 5,199,686, entitled "Non-Continuous Base Ground Level Automotive Lift System," issued Apr. 6, 1993; U.S. Pat. No. 5,190,122, entitled "Safety Interlock System," issued Mar. 2, 1993; U.S. Pat. No. 5,096,159, entitled "Automotive Lift System," issued Mar. 17, 1992; and U.S. Pat. No. 9,254,990, entitled "Multi-Link Automotive Alignment Lift," issued Feb. 9, 2016.

While a variety of vehicle lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
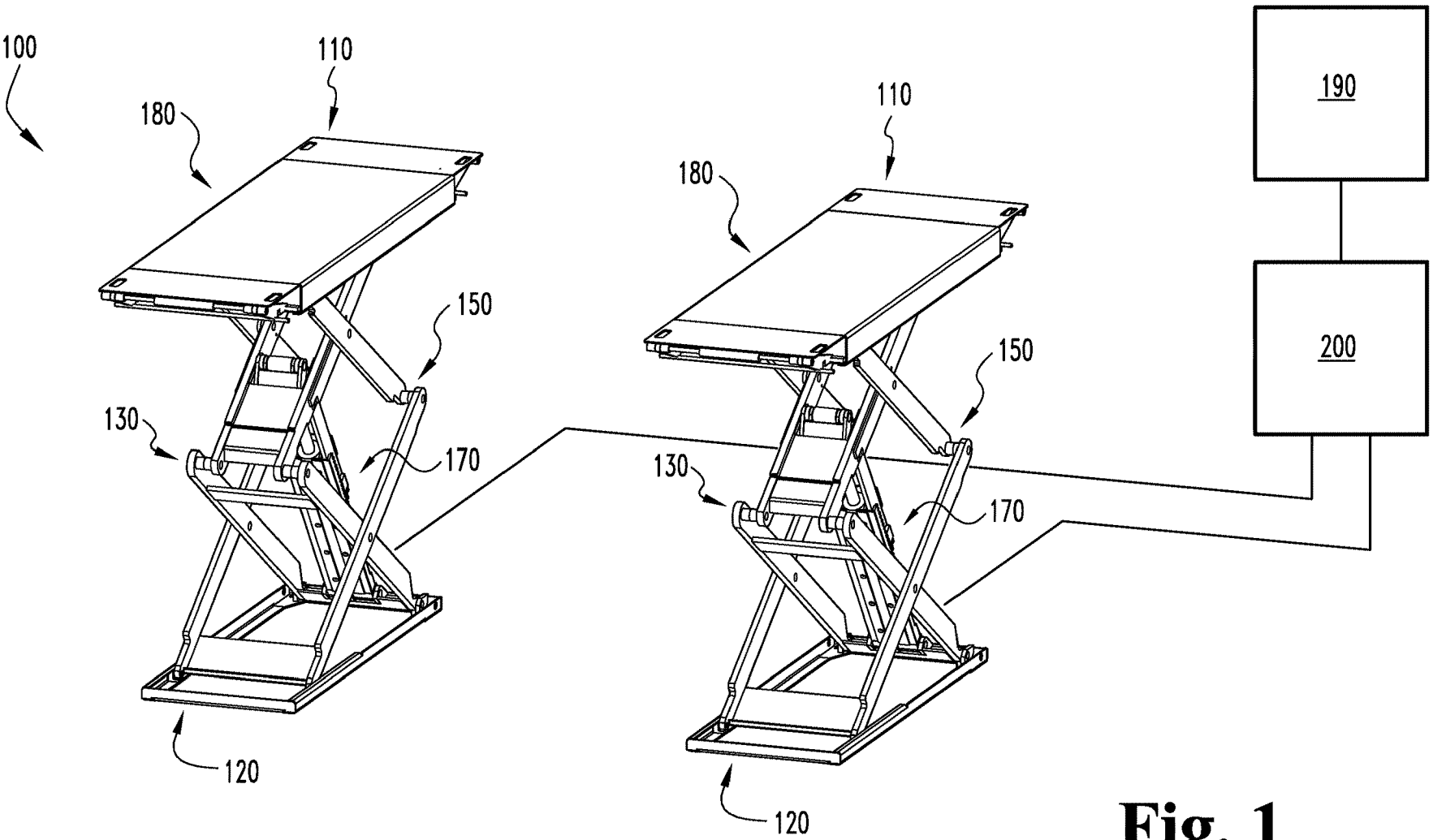
FIG. 1 is a perspective view of an exemplary vehicle lift.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

SUMMARY

A hydraulically actuated lift system includes a plurality of hydraulic actuators. In various embodiments, hydraulic fluid is supplied to the actuators by a pump through a synchronizer that has an input port connected to the pump and a plurality of output ports connected to the actuators. A piston in the synchronizer separates an input side of the interior of the synchronizer, which is in fluid communication with the input port, from an output side. The output side is partitioned into a plurality of output regions, each output region being in fluid communication with an actuator via an output port. In some implementations, some or all of the output regions are cylindrical in shape. In some embodiments, the inner diameter of the synchronizer is substantially constant throughout the input side in the output side, while in others, the inner diameter is not substantially constant throughout those regions. In some other embodiments, a given change in the volume of the first region yields more displacement from the first output region than the second output region. In still other embodiments, a pressure sensor on the line between an output region and the corresponding actuator detects when substantially less of the weight of the vehicle continues to be supported by the actuator, and both stops movement of the piston and changes the state of an indicator so that the user(s) are notified of the event.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Overview

FIG. 1 shows a perspective view of vehicle lift system (100) in a raised position. Vehicle lift system (100) comprises two scissor lift assemblies (110), a hydraulic pump assembly (190), and a synchronizer (200). Vehicle lift system (100) is operable to lift a vehicle by to a desired height by actuating scissor lift assemblies (110) from a retracted position to the extended position shown in FIG. 1. In particular, scissor lift assemblies (110) are shown in a position corresponding to each axle of a vehicle. Thus, scissor lifts assemblies (110) support a vehicle by engaging each axle while raising the vehicle to a desired height. As will be described in greater detail below, scissor lift assemblies (110) are actuated by hydraulic actuators (174) disposed therein, which are in turn actuated by hydraulic pump assembly (190). As will also be described in greater detail below, scissor lift assemblies (110) are maintained at a consistent horizontal plane through the use of synchronizer (200), which is in a fluid circuit between scissor lift assemblies (110) and hydraulic pump assembly (190). Although vehicle lift system (100) is shown as comprising two scissor lift assemblies (110), it should be understood that any suitable number of scissor lift assemblies (110) may be used. For instance, in some examples four scissor lift assemblies (110) may be used with a scissor lift assembly (110) positioned at each corner of a vehicle.

Figure 2:
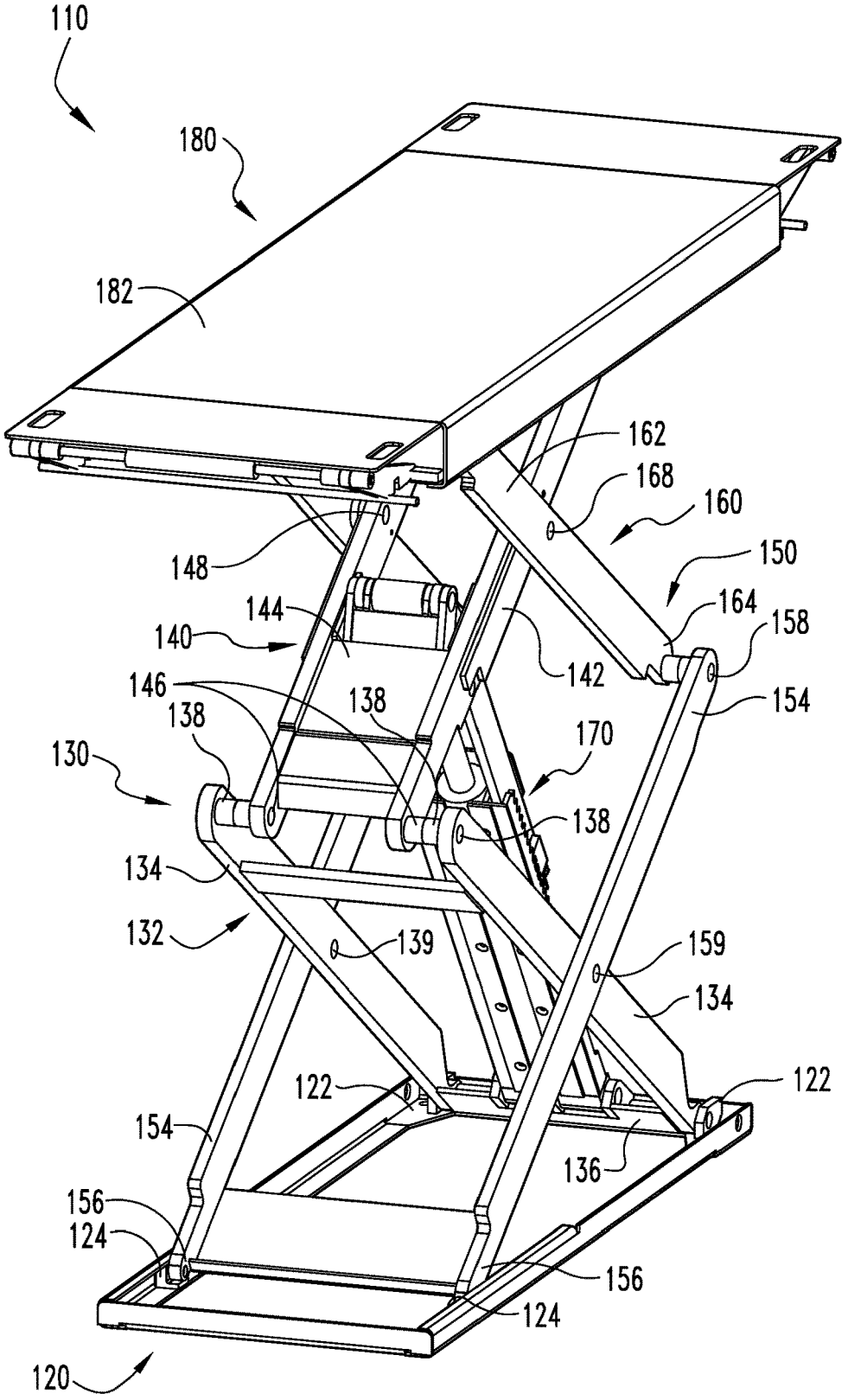
FIG. 2 is a perspective view of a scissor lift assembly of the vehicle lift of FIG. 1.
Figure 3:
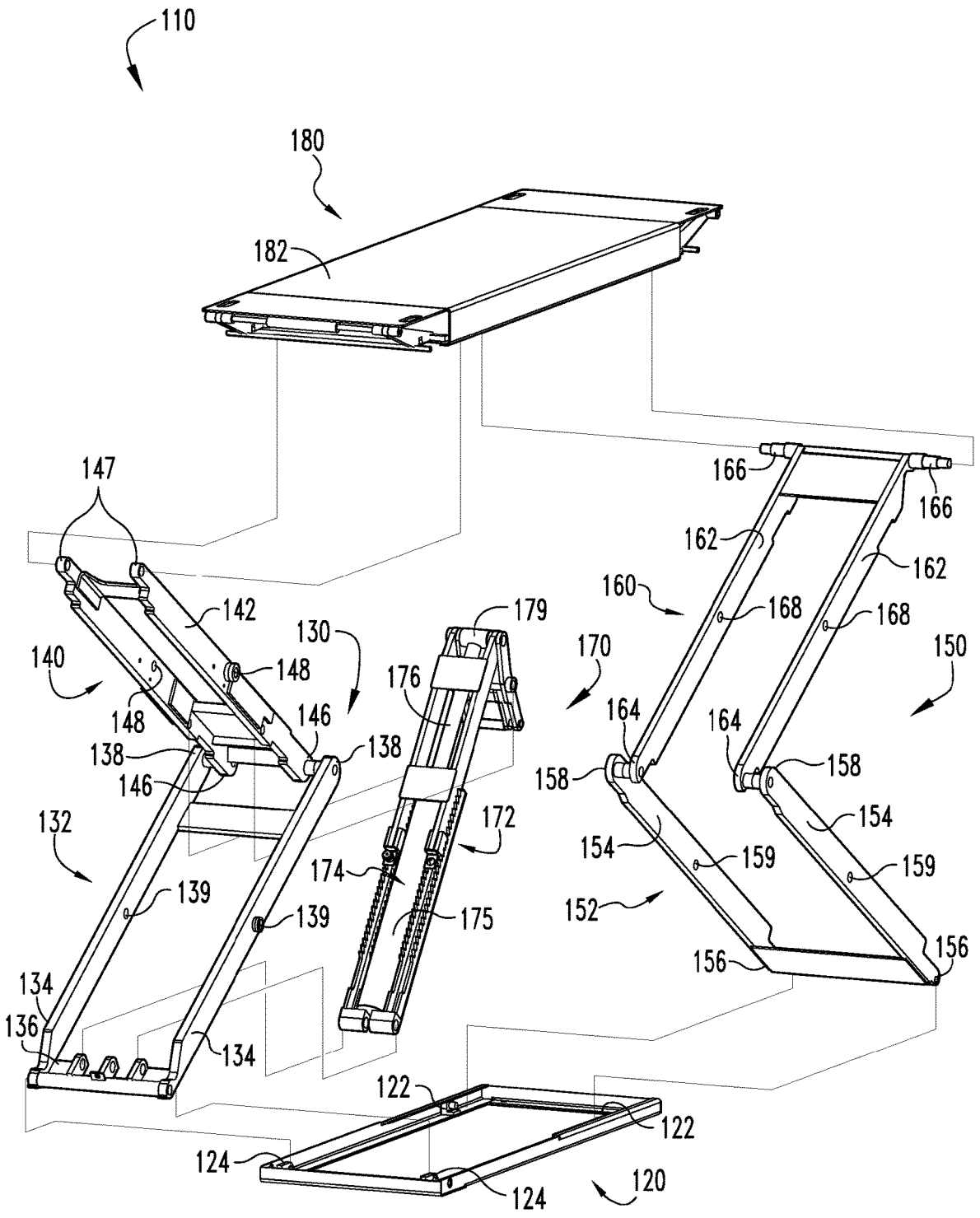
FIG. 3 is an exploded view the scissor lift assembly of FIG. 2.

As can best be seen in FIGS. 2-3, scissor lift assembly (110) comprises a base (120), a set of lifting linkages (130), a set of stabilizing linkages (150), a hydraulic actuator assembly (170), and a platform (180). Base (120) provides a stable platform to which linkages (130, 150) and the rest of scissor lift assembly (110) may mount. Base (120) may be freely movable about a shop floor, fixed in position on a shop floor, or mounted below a shop floor. When scissor lift assembly (110) is in the retracted position, platform (180) may be positioned relatively close to base (120) and thus near a shop floor. Such positioning of platform (180) may permit a vehicle to be driven or rolled over scissor lift assembly (110) prior to initiation of the lifting process. In the present example, base (120) includes a pair of fixed mounting brackets (122) and a pair of slidable mounting brackets (124). Fixed mounting brackets (122) rotatably secure a lower portion of lifting linkages (130) to base (120), as will be described in greater detail below. As will also be described in greater detail below, slidable mounting brackets (124) slidable and rotatably secure a lower portion of stabilizing linkages (150) to base (120).

Lifting linkages (130) comprise a lower linkage assembly (132) and an upper linkage assembly (140). Lower linkage assembly (132) comprises two longitudinally extending links (134) and a mounting bracket (136) fixed to the bottom of each link (134). Each link (134) of lower linkage assembly (132) is parallel to the other and is rotatably mounted to base (120) by mounting bracket (136). As will be described in greater detail below, mounting bracket (136) also rotatably mounts hydraulic actuator assembly (170) to base (120) such that links (134) and hydraulic actuator assembly (170) are rotatable about a common axis. The upper end of each link (134) comprises a top mounting portion (138), which is operable to rotatably secure each link (134) to upper linkage assembly (140). It should be understood that, while not specifically depicted in FIGS. 2 and 3, mounting brackets (136) and/or mounting portions (138) may also include bearings, pins, screws, and/or other fasteners configured to facilitate rotatable fastening as will be apparent to those of ordinary skill in the art in view of the teachings herein.

Upper linkage assembly (140) comprises two parallel longitudinally extending links (142) and a mounting bracket (144). Each link (142) includes a bottom mounting portion (146) and a top mounting portion (147). Bottom mounting portion (146) rotatably secures upper linkage assembly (140) to bottom linkage assembly (130) such that links (142) of upper linkage assembly (140) may pivot relative to links (134) of lower linkage assembly (132). As will be described in greater detail below, top mounting portion (147) rotatably secures links (142) to platform (180). As will also be describe in greater detail below, mounting bracket (144) rotatably secures hydraulic actuation assembly (170) to upper linkage assembly (140). Unlike mounting bracket (136) described above, mounting bracket (144) does not share a common axis of rotation with links (142). Instead, mounting bracket (144) is positioned such that hydraulic actuation assembly (170) may pivot links (142) about an axis defined by bottom mounting portion (146), while simultaneously pivoting links about the axis defined by mounting bracket (136). It should be understood that, while not specifically depicted in FIGS. 2 and 3, mounting brackets (144) and/or mounting portions (146) may also include bearings, pins, screws, and/or other fasteners configured to facilitate rotatable fastening as will be apparent to those of ordinary skill in the art in view of the teachings herein.

Both links (134) of lower linkage assembly (132) and links (142) of upper linkage assembly (140) comprise fastening bores (139, 148). As will be described in greater detail below, fastening bores (139, 148) rotatably couple lifting linkages (130) to support linkages (150) such that loads carried by one linkage (130, 150) may be transferred to the other linkage (150, 130). Fastening bores (139, 148) may be configured to support bearings, pins, screws, and/or other rotatable fastening devices as will be apparent to those of ordinary skill in the art in view of the teachings herein.

Stabilizing linkages (150) comprise a lower linkage assembly (152) and an upper linkage assembly (160). Lower linkage assembly (152) comprises two parallel longitudinally extending links (154). Links (154) include a bottom mounting portion (156) and a top mounting portion (158). Each bottom mounting portion (156) rotatably secures each link (154) to mounting brackets (124) on base (120). As was described above, mounting brackets (124) of base (120) are slidable relative to base (120). Accordingly, bottom mounting portions (156) are operable to both slide and pivot links (154) relative to base. As will be described in greater detail below, this sliding and pivoting feature of bottom mounting portions (156) permits scissor lift assembly (110) to articulate vertically. Top mounting portions (158) rotatably secure each link (154) to upper linkage assembly (160) such that lower linkage assembly (152) and upper linkage assembly (160) may pivot relative to each other. It should be understood that, while not specifically depicted in FIGS. 2 and 3, mounting portions (156, 158) may also include bearings, pins, screws, and/or other fasteners configured to facilitate rotatable fastening.

Upper linkage assembly (160), like lower linkage assembly (152), comprises two parallel longitudinally extending links (162). Links (162) include a bottom mounting portion (164) and a top mounting portion (166). Each bottom mounting portion (164) rotatably secures each link (162) to top mounting portions (158) of lower linkage assembly (152) such that lower linkage assembly (152) and upper linkage assembly (160) are pivotable relative to each other. Top mounting portions (166) rotatably secure each link (162) to a mounting bracket (not shown) of platform (180). The mounting brackets of platform (180) is similar to mounting brackets (124) of base (120) in that the mounting brackets of platform (180) are slidable relative to platform. Thus, top mounting portions (166) are operable to both pivot and slide links (162) relative to platform (180). As will be described in greater detail below, the sliding and pivoting action of top mounting portions (166) is operable to permit scissor lift assembly (110) to articulate vertically. It should be understood that, while not specifically depicted in FIGS. 2 and 3, mounting portions (164, 166) may also include bearings, pins, screws, and/or other fasteners configured to facilitate rotatable fastening.

Both links (154) of lower linkage assembly (152) and links (162) of upper linkage assembly (160) comprise fastening bores (159, 168). As will be described in greater detail below, fastening bores (159, 168) rotatably couple lifting linkages (130) to support linkages (150) such that loads carried by one linkage (130, 150) may be transferred to the other linkage (150, 130). Fastening bores (159, 168) may be configured to support bearings, pins, screws, and/or other rotatable fastening devices as will be apparent to those of ordinary skill in the art in view of the teachings herein.

Platform (180) is generally shaped as a longitudinally extending rectangle and includes an upper surface (182) and an open bottom (not shown). Upper surface (182) may be configured to support an axle of a vehicle. In FIGS. 2 and 3, upper surface (182) is shown as generally flat, although it should be understood that in other examples upper surface (182) may have any other suitable shape or may contain other features configured to support an axle of a vehicle. For instance, in some examples upper surface (182) may include an adaptor device, which may be selectively actuated by a user so that upper surface may adapt for axles of different shapes and/or sizes. In other examples, upper surface (182) may include a fixed geometry comprising annular indentations, which may be configured to support a specific axle shape and/or size. Of course, upper surface (182) may include any other features suitable for supporting an axle as will be apparent to those of ordinary skill in the art in view of the teachings herein.

The bottom of platform (180) houses the mounting brackets of platform (180) described above. Additionally, the bottom of platform (180) may include a track or sliding feature suitable to permit mounting bracket that connects to top mounting portion (166) to slide relative to platform (180). The bottom of platform (180) is open such that top mounting portions (147, 166) are recessed inside of platform (180). In other examples, the bottom of platform (180) may be closed and the mounting brackets of platform (180) may be disposed on the outside of platform (180).

Hydraulic actuator assembly (170) comprises a locking mechanism (172) and a hydraulic actuator (174). Locking mechanism (172) is configured to successively lock scissor lift assembly (110) as it is articulated vertically, preventing scissor lift assembly (110) from inadvertently lowering. In other words, as scissor lift assembly is articulated vertically in the upward direction, further upward articulation is permitted, yet articulation in the downward direction is prevented by locking mechanism (172). Some non-limiting examples of suitable locking mechanisms (172) have previously been described in U.S. Pub. No. 2012/0048653, entitled "Multi-Link Automotive Alignment Lift," published Mar. 1, 2012, the disclosure of which is incorporated by reference herein.

Figure 4:
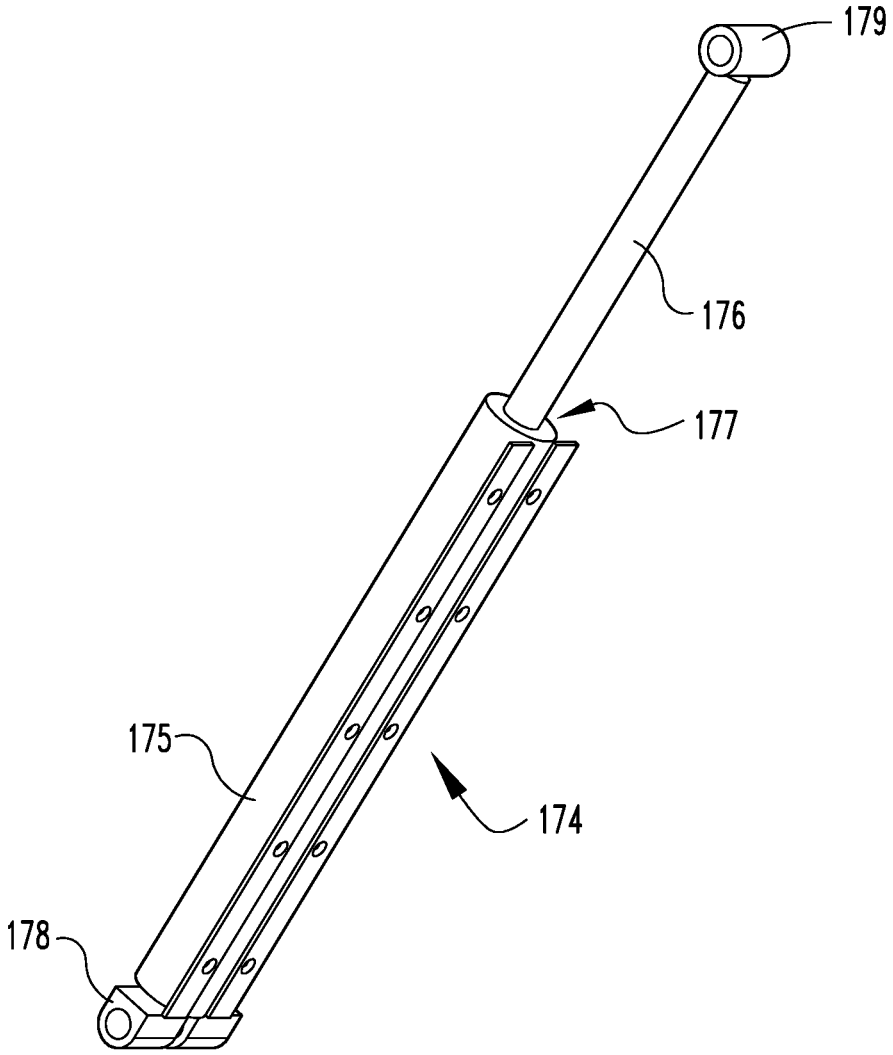
FIG. 4 is a perspective view of a hydraulic actuator of the vehicle lift of FIG. 1.

As can best be seen in FIG. 4, hydraulic actuator (174) comprises a hydraulic cylinder (175) and an elongate arm (176). Hydraulic cylinder (175) slidably receives arm (176) through an opening (177) hydraulic cylinder (175). Hydraulic cylinder (175) also includes an attachment feature (178), which permits hydraulic actuator assembly (170) to rotatably secure to mounting bracket (136) as described above. Elongate arm (176) includes a similar attachment feature (179), which permits hydraulic actuator assembly (170) to rotatably secure to mounting bracket (144) as described above. While not shown, it should be understood that elongate arm (176) may include a piston disposed within hydraulic cylinder (175), which drives elongate arm (176) outwardly from hydraulic cylinder (175) when hydraulic cylinder (175) is filled with pressurized hydraulic fluid.

In an exemplary mode of operation of scissor lift assembly (110), the articulation sequence is initiated by actuating hydraulic actuator (174), thus driving elongate arm (176) outwardly away from hydraulic cylinder (175). Mounting brackets (136, 144) are thus forced in away from each other. Because mounting bracket (136) is in a relatively fixed position, mounting bracket (144) is pushed upwardly relative to base (120). Links (134, 142) are thus pivoted relative to each other and relative to base (120) driving platform (180) upwardly in the vertical direction.

As described above, links (134, 142) of lifting linkages (130) are rotatably secured to links (154, 162) of stabilizing linkages (150) via fastening bores (139, 148, 159, 168). Because of this, the lifting force imparted upon links (134, 142) by hydraulic actuator (174) is also imparted upon links (154, 162). Thus, upward motion of lifting linkages (130) also results in upward motion of stabilizing linkages (150), which in turn results in upper surface (182) of platform (180) being raised while maintaining a relatively horizontal orientation. This lifting process continues until platform (180) is raised to a desired height.

II. Exemplary Synchronizers

As described above, multiple scissor lift assemblies (110) may be used in concert to lift a vehicle. In such circumstances, it may be desirable to maintain the hydraulic pressure supplied to each scissor lift assembly (110) at a relatively consistent level such that each scissor lift assembly (110) raises at the same rate. It should be understood that while synchronizers (200, 300, 400) discussed below are described in the context of being used with a scissor lift assembly, no such limitation is intended. In other examples, synchronizers (200, 300, 400) may be used with any other type of vehicle lift utilizing multiple hydraulic actuators (174). For instance, synchronizers (200, 300, 400) may be used with two post lifts, four post lifts, in-ground hydraulic lifts, etc. In yet other examples, synchronizers may be used with other variations of scissor lifts besides those discussed herein. Still in other examples, the principles taught herein with respect to synchronizers (200, 300, 400) may be used in non-vehicle lift applications where multiple hydraulic actuators (174) are utilized. In still further examples, the teachings herein may be applied to completely non-hydraulic applications such as with dispensing chemicals at a predetermined ratio for industries such medical, adhesives, petroleum, and the like.

A. Exemplary Two-Cavity Synchronizer

Figure 5:
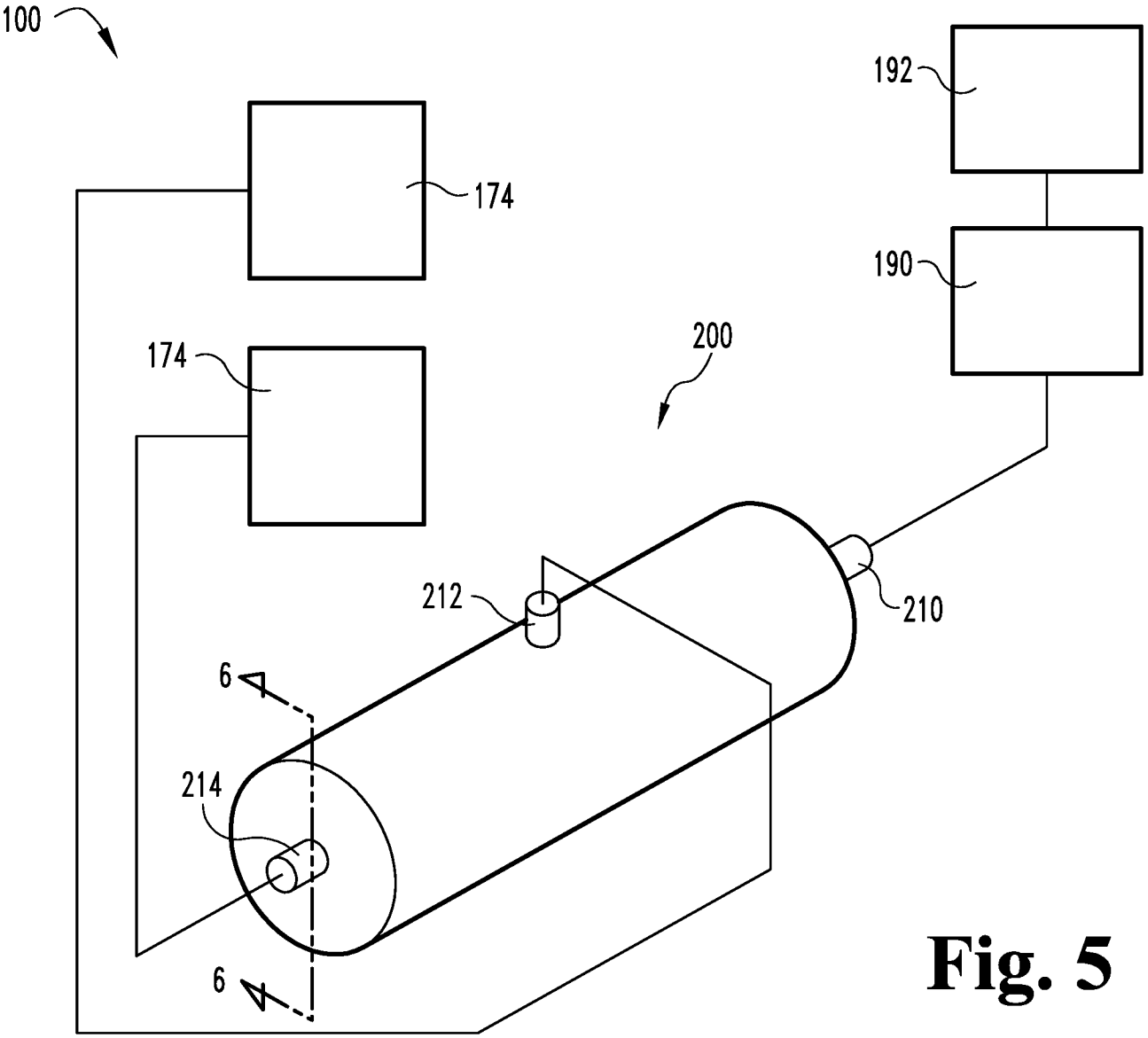
FIG. 5 is a perspective view of a synchronizer of the vehicle lift of FIG. 1.
Figure 6:
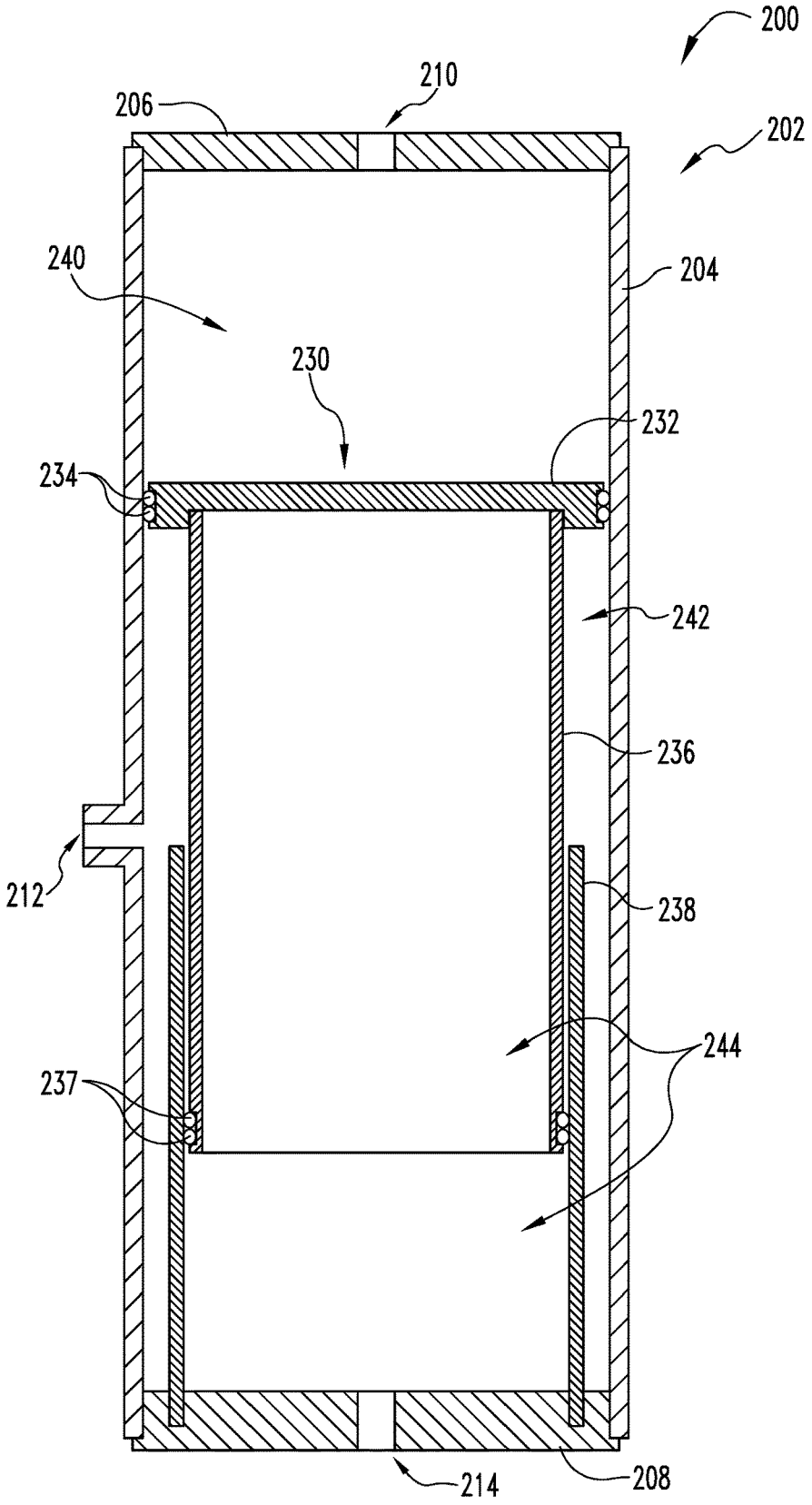
FIG. 6 is a side cross-sectional view of the synchronizer of FIG. 5 in an unactuated position, the cross-section taken along line 6-6 of FIG. 5.
Figure 7:
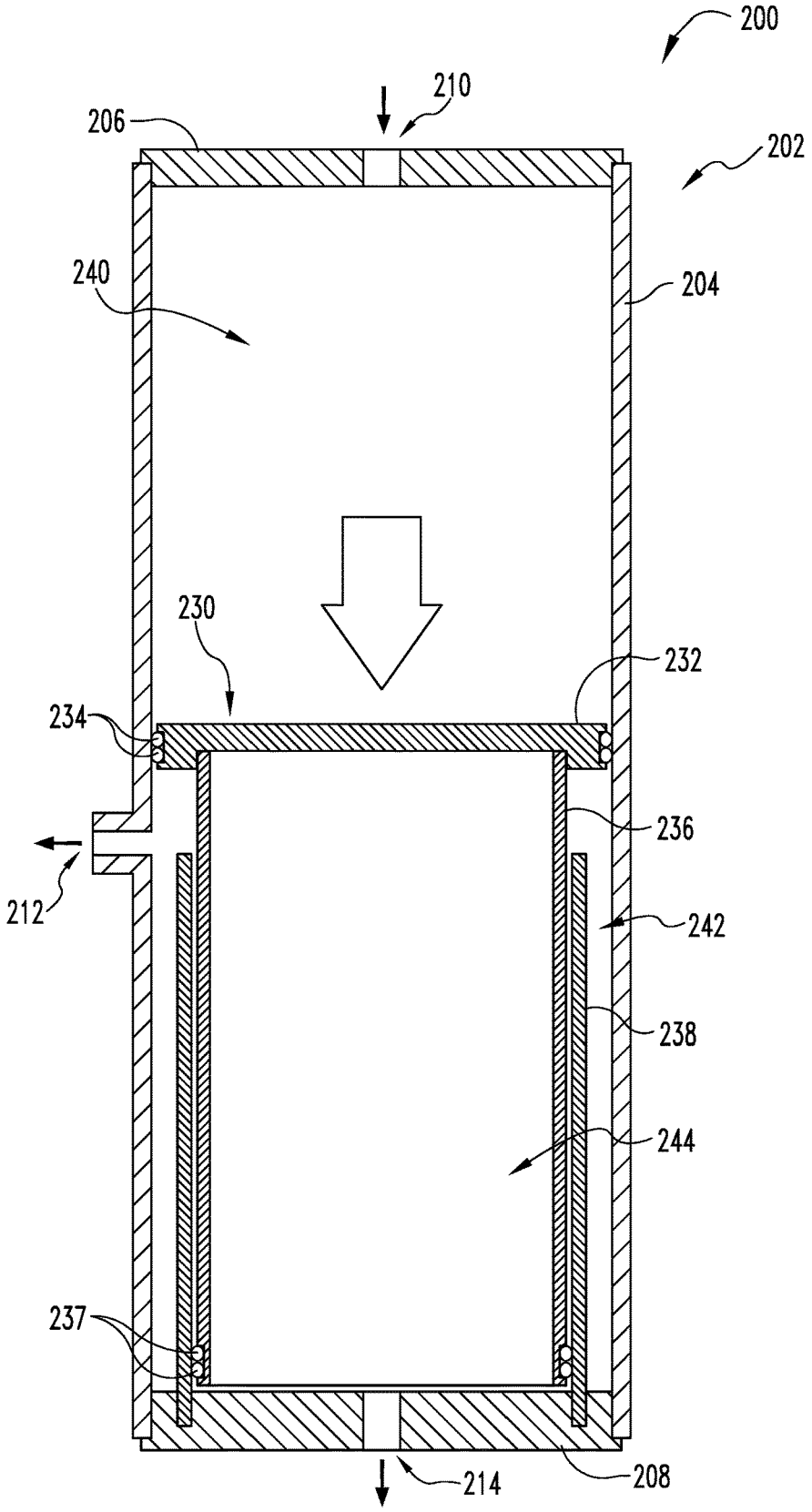
FIG. 7 is a side cross-sectional view of the synchronizer of FIG. 5 in an actuated position, the cross-section taken along line 6-6 of FIG. 5.

FIGS. 5-7 show an exemplary synchronizer (200), which may be used with vehicle lift system (100). Synchronizer (200) of the present example is configured to synchronize the hydraulic pressure of two hydraulic actuators (174). In particular, as can be seen in FIG. 5, synchronizer (200) comprises a generally cylindrical outer housing (202), a single input port (210) and two output ports (212, 214). Input port (210) is oriented on the top of housing (202) (shown as the right side in FIG. 5) and is in communication with hydraulic pump (190). Hydraulic pump (190) may be in communication with a fluid reservoir (192), although in some examples fluid reservoir (192) may be combined with hydraulic pump (190). Output ports (212, 214) are each in communication with a separate hydraulic actuator (174) such as hydraulic actuator (174) described above. Output port (212) is positioned on the side of housing (202), while output port (214) is positioned on the bottom of housing (202) (shown as the left side in FIG. 5).

FIG. 6 shows a cross section of synchronizer (200). As can be seen, housing (202) comprises a side wall (204) and two end caps (206, 208). Although housing (202) is shown as comprising three separate parts, it should be understood that in other examples housing (202) may comprise a single unitary part or may comprise several other parts. Housing (202) defines a single internal chamber (220), which houses a piston assembly (230). Piston assembly (230) comprises a piston (232) and two hollow shafts (236, 238). Piston (232) and hollow shafts (236, 238) together define an input cavity (240), a first output cavity (242) and a second output cavity (244).

Input cavity (240) is defined by housing (202) and piston (232). In particular, piston (232) separates input cavity (240) from cavities (242, 244). In the present example, piston (232) includes seals (234), which fluidly isolate input cavity (240) from cavities (242, 244). Seals (234) also permit piston (232) to be slidable within housing (202). As will be described in greater detail below, piston (232) may slide within housing (202) to vary the volume of each cavity (240, 242, 244). In the present example, seals (234) (and any other seal described herein) comprise rubber o-rings, although any suitable seal may be used as will be apparent to those of ordinary skill in the art in view of the teachings herein.

Piston (232), housing (202) and shafts (236, 238) together define first and second output cavities (242, 244). In particular, first hollow shaft (236) extends downwardly from piston (232). Second hollow shaft (238) is coaxial with first hollow shaft (236) and extends upwardly from end cap (208). First hollow shaft (236) includes seals (237), which may fluidly isolate first output cavity (242) from second output cavity (244) by engagement with second hollow shaft (236). While first hollow shaft (236) is shown as comprising seals (237), it should be understood that in other examples, second hollow shaft (236) may comprise seals (237). In yet other examples, both first and second hollow shafts (236, 238) may comprise seals (237). Of course, any other suitable configuration of seals (237) may be used.

Regardless of seal (237) configuration, first output cavity (242) is defined by the exterior of each hollow shaft (236, 238), housing (202), and piston (232). Similarly, second output cavity (244) is defined by the interior of each hollow shaft (236, 238), housing (202), and piston (232). Seals (237) permit first hollow shaft (236) to be slidable relative to second hollow shaft (238). As will be described in greater detail below, first hollow shaft (236) may be driven by piston (232) such that first hollow shaft (236) slides relative to second hollow shaft (238) to vary the volume of first output cavity (242) and second output cavity (244). Although hollow shaft (236) is shown as being hollow, it should be understood that in some examples hollow shaft (236) may be partially or fully solid. Thus, second output cavity (244) may alternatively be defined by the space between first hollow shaft (236) and the interior of second hollow shaft (238).

Each cavity (240, 242, 244) is in communication with a respective port (210, 212, 214). In particular, input cavity (240) is in communication with input port (210), which, as described above, is in communication with hydraulic pump (190). First output cavity (242) is in communication with first output port (212), which, as described above, may be in communication with a hydraulic actuator (174). Similarly, second output cavity (242) is in communication with second output port (214), which, as described above, may be in communication with a hydraulic actuator (174). It should be understood that the volume of input cavity (240) bears a direct relationship with the volume of output cavities (242, 244). For instance and as will be described in greater detail below, an expansion of the volume of input cavity (240) (e.g., via hydraulic pump (190)) may result in a corresponding decrease in the volume of output cavities (242, 244). The particular relationship between the volumes of each cavity (240, 242, 244) may be defined by varying the size and/or shape of the various parts described above. In other words, although housing (202), piston (232) and hollow shafts (236, 238) are shown as having certain sizes defining the volume of cavities (240, 242, 244), such sizes may be varied to vary the volume of cavities (240, 242, 244) and the corresponding relationships between the volumes. In other embodiments, the sizes are varied or controlled by placement and/or operation of a plunger (not shown) within output cavity (244).

An exemplary mode of operation of synchronizer (200) can be seen by comparing FIGS. 6 and 7. In particular, input cavity (240) may be filled with hydraulic fluid via hydraulic pump (190). As input cavity (240) is filled, piston (232) may be driven downwardly by the building pressure of the hydraulic fluid in input cavity (240). As piston (232) is driven downwardly, first hollow shaft (236) is correspondingly driven downwardly.

As piston (232) and first hollow shaft (236) are driven downwardly, the volume of output cavities (242, 244) decreases proportionally to the increase of volume of input cavity (240). Each output cavity (242, 244) may be filled with hydraulic fluid such that a decrease in volume of each output cavity (242, 244) may expel a corresponding amount of hydraulic fluid from output ports (212, 214) to hydraulic actuators (174).

The particular volume of hydraulic fluid received by each hydraulic actuator (174) is determined by the particular change in volume of each output cavity (242, 244) in response to the change in volume of input cavity (240). Thus, synchronizer (200) may be configured to supply a particular volume of hydraulic fluid to a given hydraulic actuator (174). For instance, in some examples each hydraulic actuator (174) may require the same amount of hydraulic fluid to be fully actuated. In such an example, output cavities (242, 244) may be configured to expel the same volume of hydraulic fluid as the volume of input cavity (240) increases.

In yet other examples, each hydraulic actuator (174) may have different hydraulic fluid requirements. In such examples, output cavities (242, 244) may be configured to expel different volumes of hydraulic fluid as the volume of input cavity (240) increases such that the amount of hydraulic fluid expelled from each output cavity (242, 244) corresponds to the needs of a given hydraulic actuator (174).

B. Multi-Cavity Synchronizer

Figure 8:
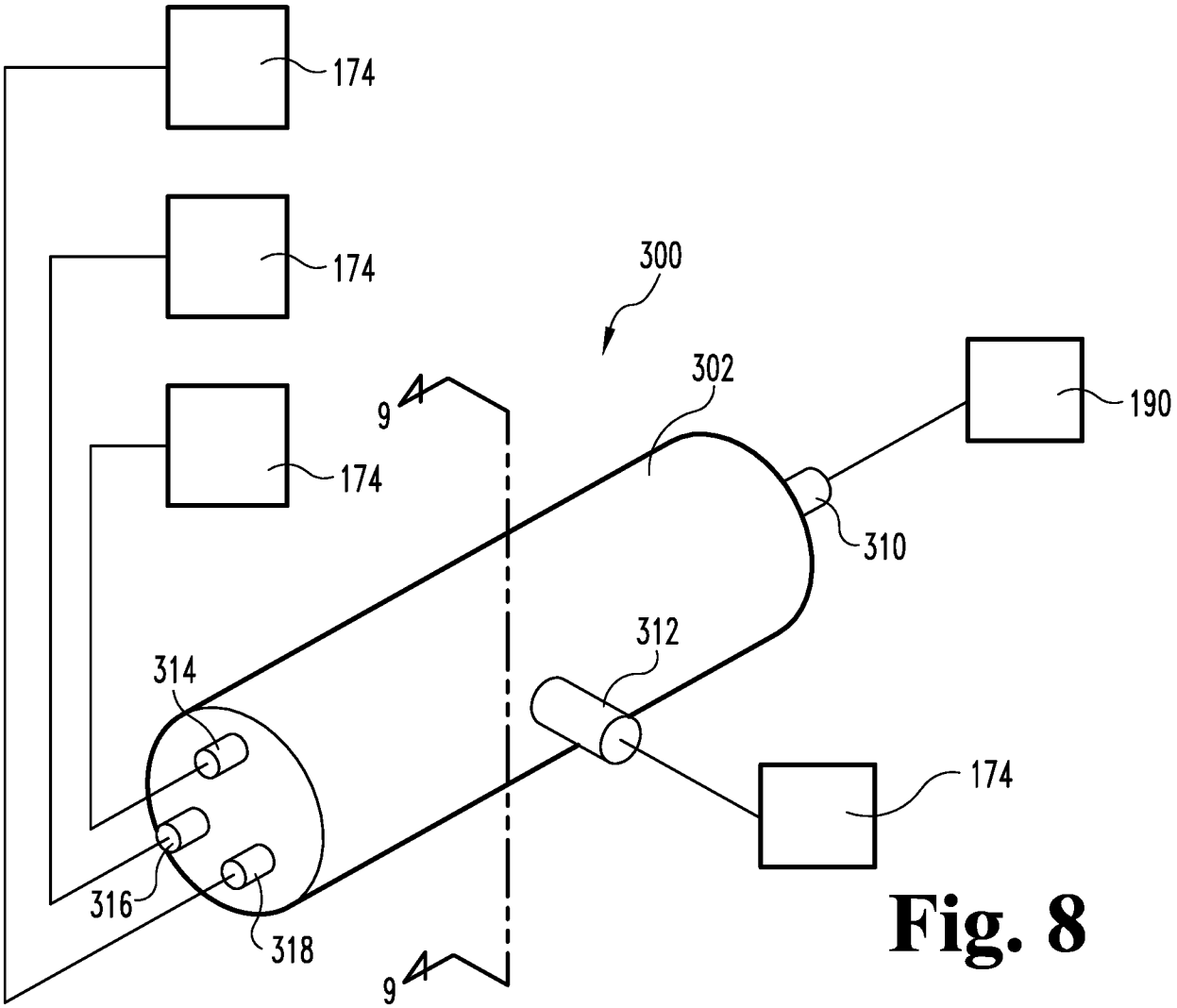
FIG. 8 is a perspective view of an exemplary alternative synchronizer for use with the vehicle lift of FIG. 1.
Figure 9:
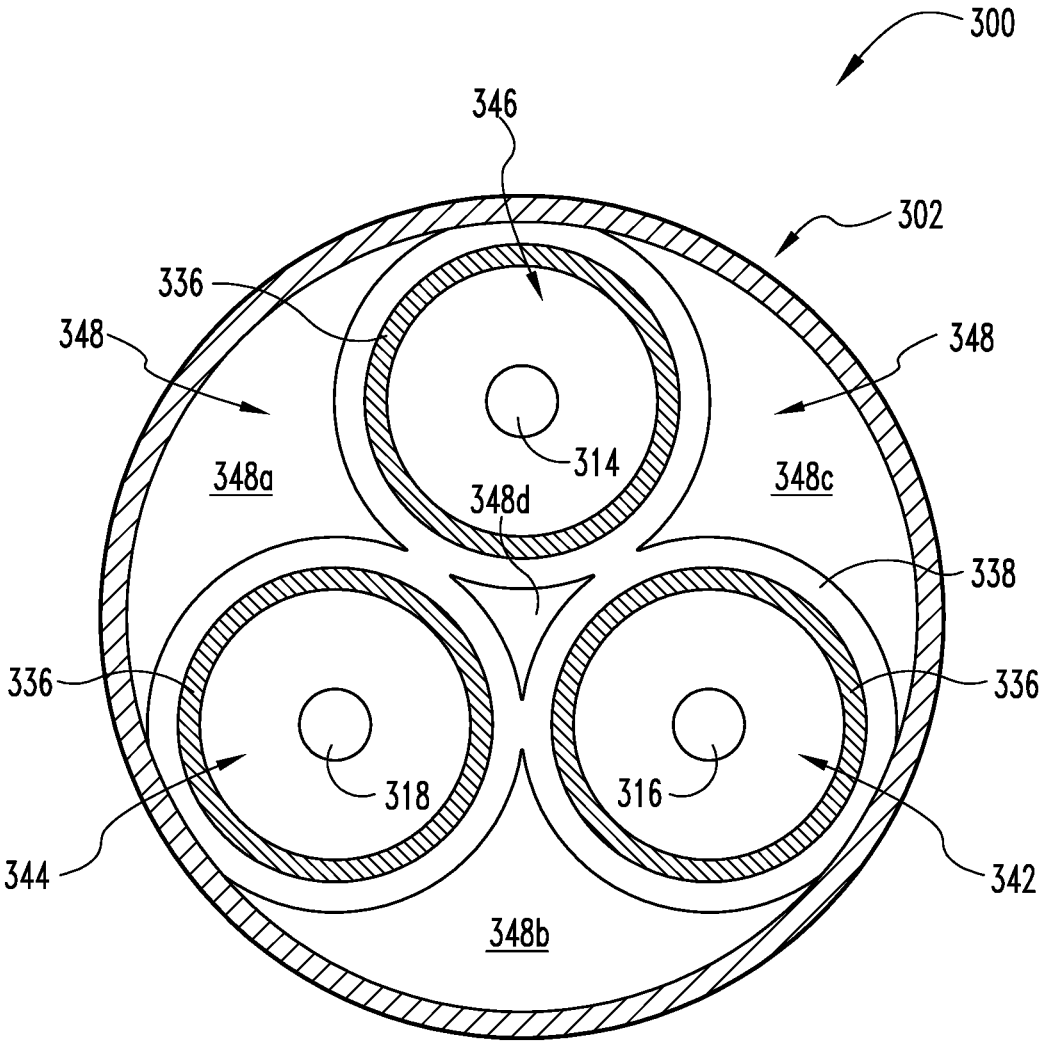
FIG. 9 is a top cross-sectional view of the synchronizer of FIG. 8, the cross-section taken along line 9-9 of FIG. 8.

FIGS. 8-9 show an exemplary alternative synchronizer (300), which may be used with vehicle lift system (100). Synchronizer (300) of the present example is substantially the same as synchronizer (200) discussed above, except as otherwise noted herein. As can be seen in FIG. 8, synchronizer (300) comprises a generally cylindrical outer housing (302), a single input port (310) and four output ports (312, 314, 316, 318). Input port (310) is oriented on the top of housing (302) (shown as the right side in FIG. 8). Like input port (210), input port (310) may be in communication with hydraulic pump (190). Hydraulic pump (190) may be in communication with a fluid reservoir (not shown), although in some examples the fluid reservoir may be combined with hydraulic pump (190). Output ports (312, 314, 316, 318) are each in communication with a separate hydraulic actuator (174) such as hydraulic actuator (174) described above in connection with FIG. 4. Output port (312) is positioned on the side of housing (302), while output ports (314, 316, 318) are positioned on the bottom of housing (302) (shown as the left side in FIG. 8).

FIG. 9 shows a cross section of synchronizer (300). Housing (302) defines a single internal chamber (320), which houses three substantially similar piston assemblies (330, 331, 333). Each piston assembly (330, 331, 333) may be actuated by a single piston (not shown) and comprises two hollow shafts (336, 338). The piston and hollow shafts (336, 338) together define an input cavity (not shown), a first output cavity (342), a second output cavity (344), a third output cavity (346), and a fourth output cavity (348).

Hollow shafts (336, 338) are substantially the same as hollow shafts (236, 238) described above, except hollow shafts (336, 338) are multiplied such that synchronizer (300) has three separate sets of hollow shafts (336, 338). Although second hollow shafts (338) are shown as touching each other and as touching housing (302), it should be understood that second hollow shafts (338) may be configured to be entirely separate from each other. In examples where second hollow shafts (338) are touching, hollow shafts (338) may also include fluid passages (not shown), which may connect the various portions (348*a*, 348*b*, 348*c*, 348*d*) of fourth output cavity (348) together. Of course, such passages are merely optional and may be omitted in other examples.

Like with output cavities (242, 244) of synchronizer (200), output cavities (342, 344, 346, 348) are each in communication with a respective output port (312, 314, 316, 318) such that output cavities (342, 344, 346, 348) are in communication with a particular hydraulic actuator (174). Similarly, the input cavity is in communication with input port (310) such that the input cavity is in communication with hydraulic pump (190). Thus, hydraulic pump (190) is operable to drive the piston of synchronizer (300) by filling input cavity with pressurized hydraulic fluid. Synchronizer (300) thus operates substantially the same as synchronizer (200) described above with the piston being operable to drive each first hollow shaft (336) relative to each second hollow shaft (338) to vary the volume of each output chamber (342, 344, 346, 348). However, instead of synchronizing two hydraulic actuators (174) as did synchronizer (200), synchronizer (300) synchronizes four hydraulic cylinders (174). Although synchronizer (300) is shown as having four output cavities (342, 344, 346, 348), it should be understood that the teachings herein may be applied to synchronizer (300) such that synchronizer (300) may have any suitable number of cavities (342, 344, 346, 348) to synchronize any suitable number of hydraulic actuators (174) as will be apparent to those of ordinary skill in the art in view of the teachings herein.

C. Exemplary Multi-Part Housing Synchronizer

Figure 10:
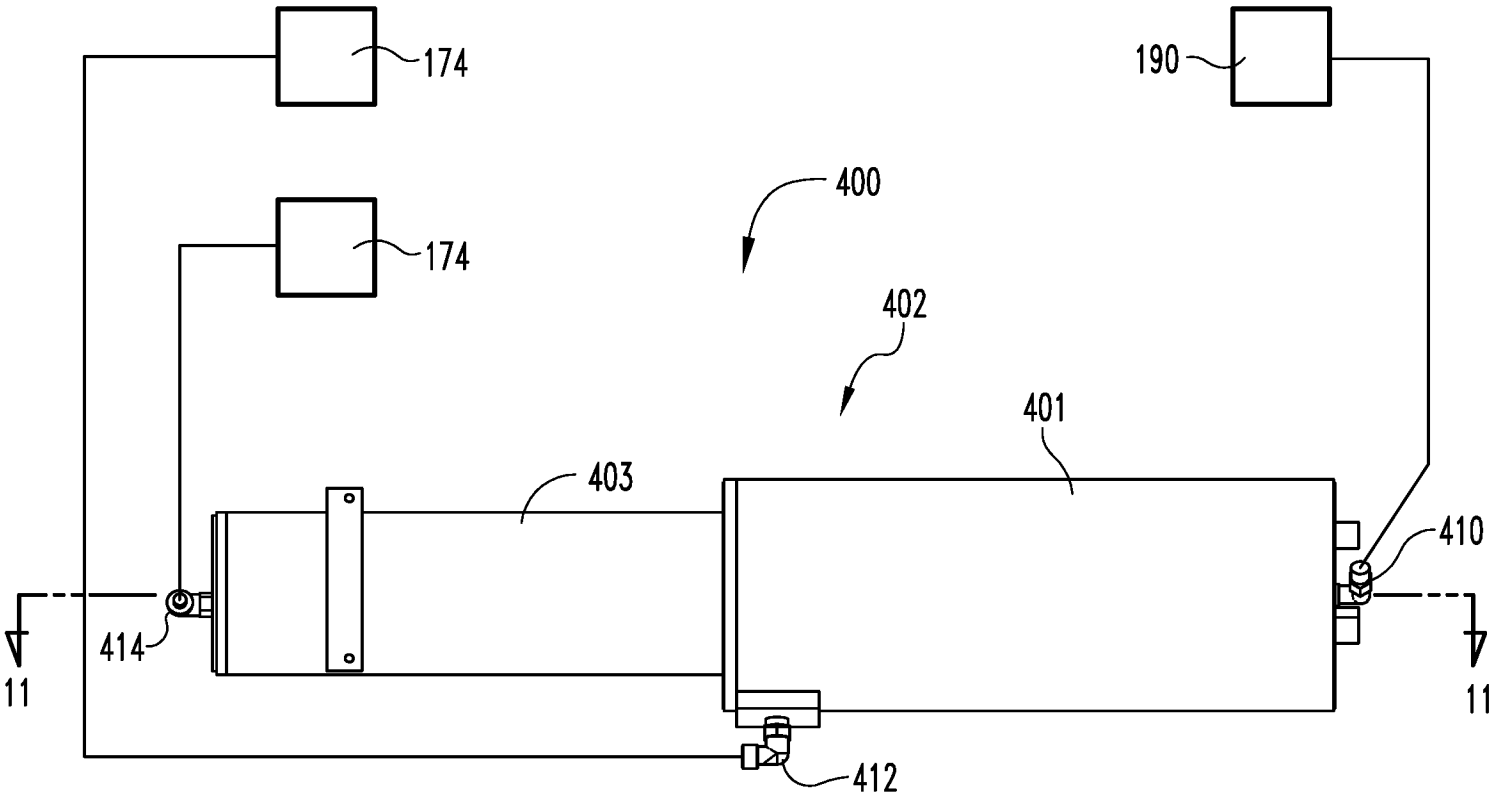
FIG. 10 is a side elevational view of an alternative exemplary synchronizer for use with the vehicle lift of FIG. 1.
Figure 11:
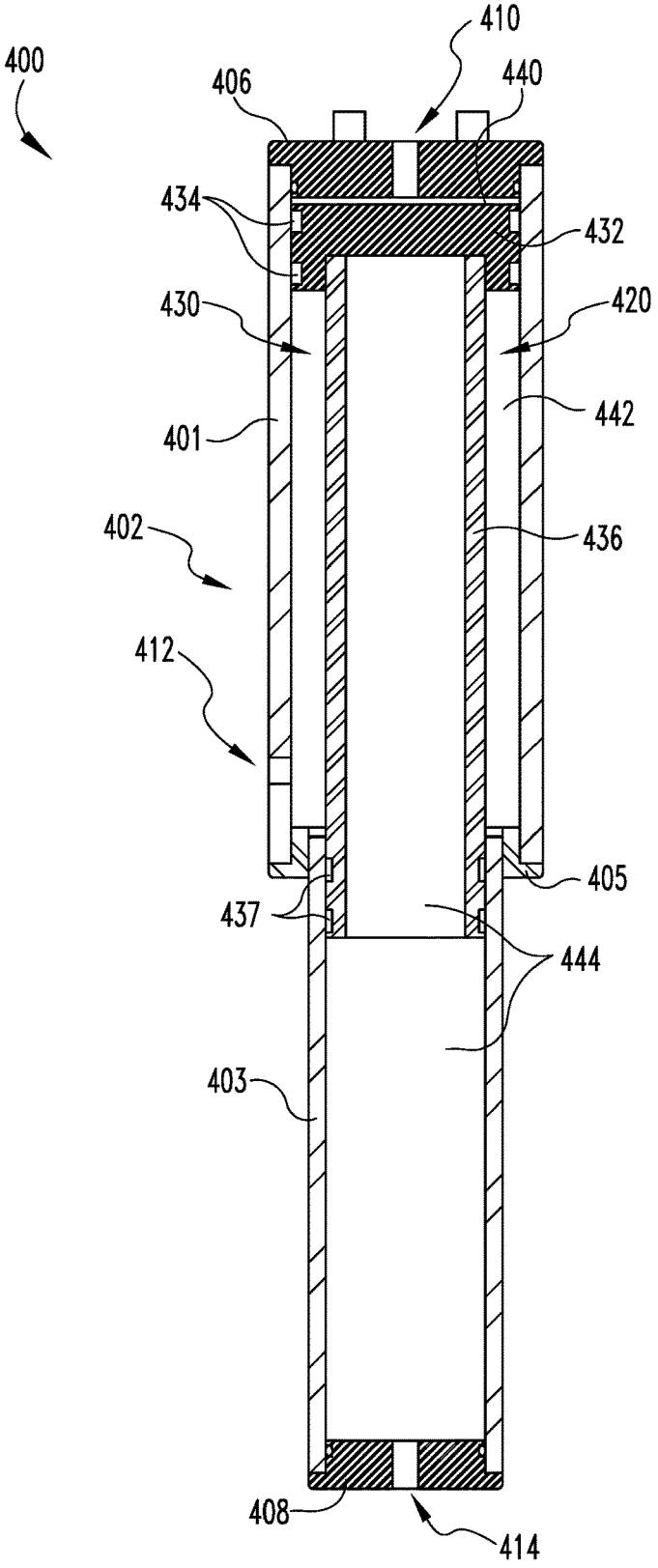
FIG. 11 is a side cross-sectional view of the synchronizer of FIG. 10 in an unactuated position, the cross-section taken along line 11-11 of FIG. 10.
Figure 12:
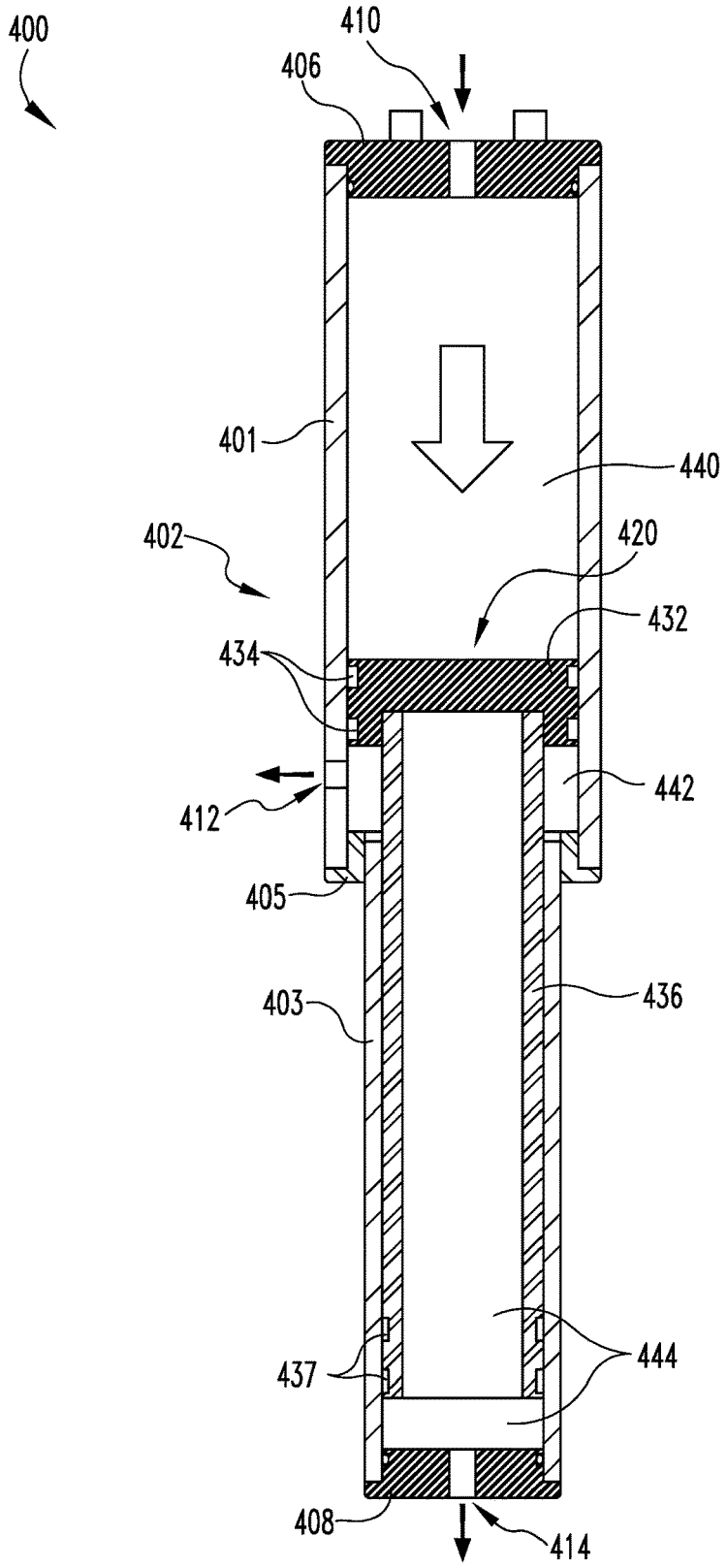
FIG. 12 is a side cross-sectional view of the synchronizer of FIG. 10 in an actuated position, the cross-section taken along line 11-11 of FIG. 10.

FIGS. 10-12 show another exemplary alternative synchronizer (400), which may be used with vehicle lift system (100). Synchronizer (400) of the present example is substantially the same as synchronizer (200), described above, except where otherwise noted herein. As can be seen in FIG. 10, synchronizer (400) comprises a generally cylindrical, two-part outer housing (402), a single input port (410) and two output ports (412, 414). Housing (402) comprises a top portion (401), and a bottom portion (403). Top portion (403) is larger in diameter than bottom portion (401) such that housing (402) steps down in diameter as it extends from top to bottom. As will be described in greater detail below, this characteristic of housing (402)

Input port (410) is oriented on the top of housing (402) (shown as the right side in FIG. 10) and is in communication with hydraulic pump (190). Output ports (412, 414) are each in communication with a separate hydraulic actuator (174) such as hydraulic actuator (174) described above. In the illustrated embodiment, output port (412) is positioned on the side of housing (402), while output port (414) is positioned on the bottom of housing (402) (shown as the left side in FIG. 10). In alternative embodiments, output port (412) is in the top of bottom portion (403) of housing (402), while in other embodiments output ports (412, 414) are positioned elsewhere as will occur to those skilled in the art.

FIG. 11 shows a cross section of synchronizer (400). As can be seen, top and bottom portions (401, 403) of housing (402) are connected by a joining member (405) to form a side wall (404). Top and bottom portions (401, 403) further include two end caps (406, 408), which seal the top and bottom ends of housing (402). Although housing (402) is shown as comprising four separate parts, it should be understood that in other examples housing (402) may comprise a single unitary part or may comprise several other parts. Housing (402) defines a single internal chamber (420), which houses a piston assembly (430). Piston assembly (430) comprises a piston (432) and a single hollow shaft (436). Piston (432), hollow shaft (436), and top and bottom portions (401, 403) of housing (402) together define an input cavity (440), a first output cavity (442) and a second output cavity (444).

Input cavity (440) is defined by top portion (401) of housing (402) and piston (432). In particular, piston (432) separates input cavity (240) from first output cavity (442). In the present example, piston (432) includes seals (434), which fluidly isolate input cavity (440) from first output cavity (442). Seals (434) also permit piston (432) to be slidable within housing (402). As will be described in greater detail below, piston (432) may slide within housing (402) to vary the volume of each cavity (440, 442, 444). In the present example, seals (434) (and any other seal described herein) comprise rubber o-rings, although any suitable seal may be used as will be apparent to those of ordinary skill in the art in view of the teachings herein.

Piston (432), top portion (401) of housing (202), and shaft (436) together define first output cavity (442). In particular, hollow shaft (436) extends downwardly from piston (432) into bottom portion (403) of housing (402). Hollow shaft (436) includes seals (437), which may fluidly isolate first output cavity (442) from second output cavity (444) by engagement with bottom portion (403) of housing (402).

First output cavity (442) is further defined by the exterior of hollow shaft (436), top portion (401) of housing (402), and piston (432). Similarly, second output cavity (444) is defined by the interior of hollow shaft (436), bottom portion (403) of housing (402), and piston (432). Seals (437) permit hollow shaft (436) to be slidable relative to bottom portion (403) of housing (402). As will be described in greater detail below, hollow shaft (436) may be driven by piston (432) such that hollow shaft (436) slides relative to bottom portion (403) of housing (402) to vary the volume of first output cavity (442) and second output cavity (444). Although hollow shaft (436) is shown as being hollow, it should be understood that in some examples hollow shaft (436) may be solid. Thus, second output cavity (444) may alternatively be defined by the space between hollow shaft (436) and the interior of bottom portion (403) of housing (402).

Each cavity (440, 442, 444) is in communication with a respective port (410, 412, 414). In particular, input cavity (440) is in communication with input port (410), which, as described above, is in communication with hydraulic pump (190). First output cavity (442) is in communication with first output port (412), which, as described above, may be in communication with a hydraulic actuator (174). Similarly, second output cavity (442) is in communication with second output port (414), which, as described above, may be in communication with a hydraulic actuator (174). It should be understood that the volume of input cavity (440) bears a direct relationship with the volume of output cavities (442, 444). For instance, and as will be described in greater detail below, an expansion of the volume of input cavity (440) (e.g., via hydraulic pump (190)) may result in a corresponding decrease in the volume of output cavities (442, 444). The particular relationship between the volumes of each cavity (440, 442, 444) may be defined by varying the size and/or shape of the various parts described above. In other words, although housing (402), piston (432), and hollow shaft (436) are shown as having certain sizes defining the volume of cavities (440, 442, 444), such sizes may be varied to vary the volume of cavities (440, 442, 444) and the corresponding relationship between the volumes.

An exemplary mode of operation of synchronizer (400) can be seen by comparing FIGS. 11 and 12. In particular, input cavity (440) may be filled with hydraulic fluid via hydraulic pump (190). As input cavity (440) is filled, piston (432) may be driven downwardly by the building pressure of the hydraulic fluid in input cavity (440). As piston (432) is driven downwardly, hollow shaft (436) is correspondingly driven downwardly.

As piston (432) and hollow shaft (436) are driven downwardly, the volume of output cavities (442, 444) decreases proportionally to the increase of volume of input cavity (440). Each output cavity (442, 444) may be filled with hydraulic fluid such that a decrease in volume of each output cavity (442, 444) may expel a corresponding amount of hydraulic fluid from output ports (412, 414) to hydraulic actuators (174).

The particular volume of hydraulic fluid received by each hydraulic actuator (174) is determined by the particular change in volume of each output cavity (442, 444) in response to the change in volume of input cavity (440). Thus, synchronizer (400) may be configured to supply a particular volume of hydraulic fluid to a given hydraulic actuator (174). For instance, in some examples each hydraulic actuator (174) may require the same amount of hydraulic fluid to be fully actuated. In such an example, output cavities (442, 444) may be configured to expel the same volume of hydraulic fluid as the volume of input cavity (440) increases. In other examples, each hydraulic actuator (174) may have different hydraulic fluid requirements. In such examples, output cavities (442, 444) may be configured to expel different volumes of hydraulic fluid as the volume of input cavity (440) increases such that the amount of hydraulic fluid expelled from each output cavity (442, 444) corresponds to the needs of a given hydraulic actuator (174).

Figure 13:
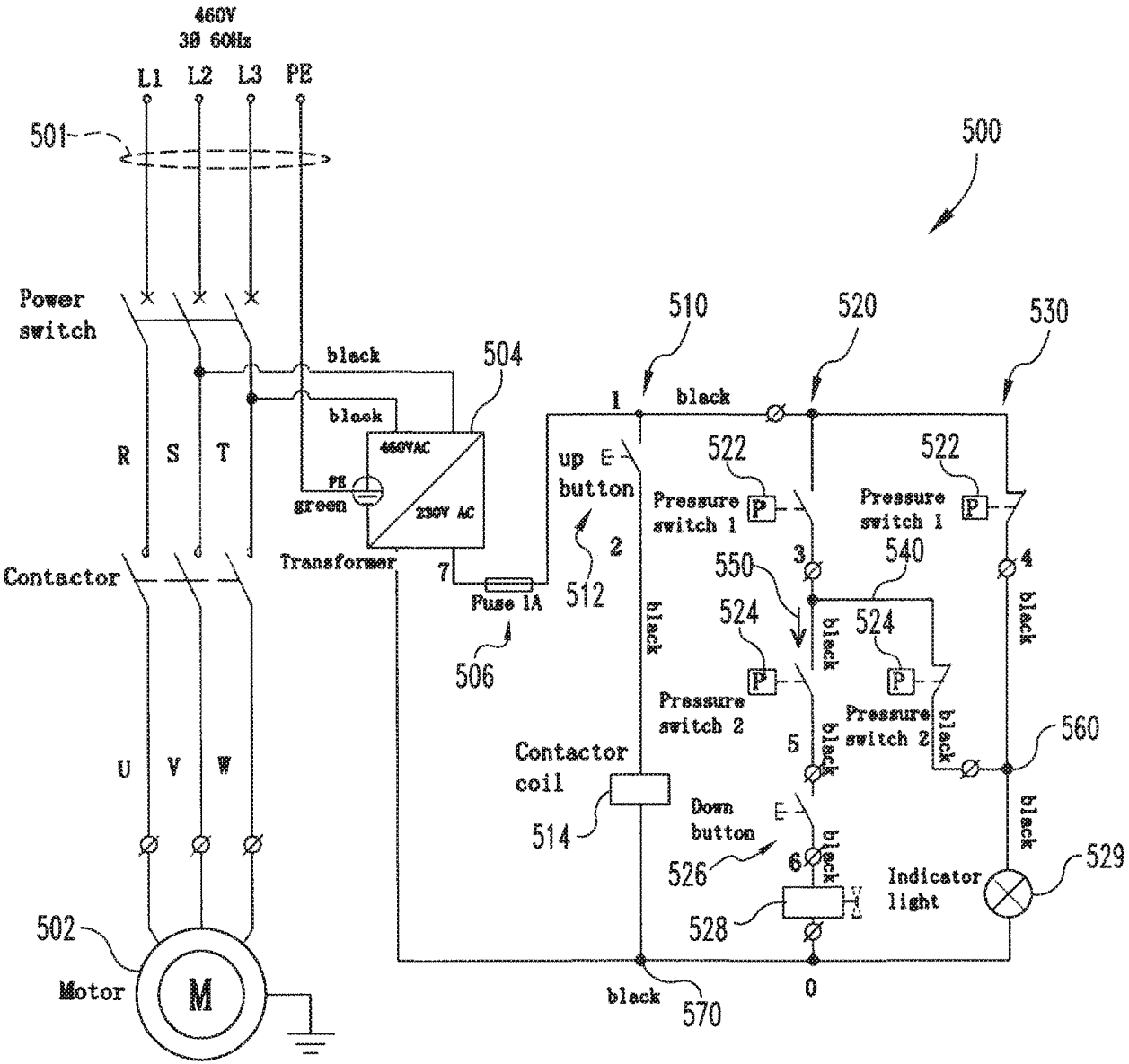
FIG. 13 is a schematic view of a block-scissor shut off system for use with the vehicle lift of FIG. 1.

FIG. 13 illustrates an automatic shut off circuit for use in some embodiments of vehicle lift system (100). In the illustrated implementation of shut off circuit (500), either mains lines (501) provide or motor (502) generates three-phase power, which is stepped down by transformer (504). Other implementations will use single-phase power or other power configurations as will occur to those skilled in the art. Fuse (506) protects parallel circuit branches (510, 520, 530) from excess current. Branch (510) comprises a normally open "up" control button (512) on a control device as will occur to those skilled in the art. "Up" control button (512) is in series with contactor coil (514) in branch (510) so that, when "up" control button (512) is actuated, current flows through contactor coil (514), and a pump (such as pump (190)) operates to raise lifts (110) via a synchronizer (200, 300, 400).

In branch (520) of circuit (500), a normally open throw of pressure switch (522), which is closed when sufficient pressure is detected in a hydraulic line in communication with a first actuator (174) in a multiple-lift system (100), is connected in series with "down" control button (526), lowering solenoid valve (528), and a normally open throw of pressure switch (524) (which is closed when sufficient pressure is detected in a hydraulic line in communication with the second actuator (174) in a multiple-lift system (100)). Thus, when both actuators (174) are bearing weight of a vehicle, lowering solenoid valve (528) is effectively controlled by "down" control button (526). If either actuator ceases to bear sufficient weight (such as where an object impedes the movement of a lift platform (180) or has been moved under the vehicle while it was raised), one of the pressure switches (522, 524) opens, and "down" button (526) is deenergized.

A normally closed throw of pressure switch (522) is situated in path (530) and is in series with a normally closed throw of pressure switch (524) and indicator light (529). Thus, if sufficient pressure is detected to move either pressure switch (522) or pressure switch (524) from its normal position, lowering solenoid valve (528) is not energized, and if both are moved from their normal positions (such as when carriages (6) have been lowered to a locked position, supported mechanically by a tower), lower-to-lock indicator light (529) is energized.

In alternative embodiments to system (500), alternative circuitry renders both lifting and lowering hydraulic components in operative when pressure sensors indicate a loss of pressure in the actuator supply lines. In still other embodiments, hydraulic components are not deenergized when the associated lift is below a certain height (so that loss of pressure is likely because the vehicle is resting, in whole or in part, on the floor). Further variations will occur to those having ordinary skill in the art in view of this disclosure.

While certain embodiments have been described herein as using one or more "pressure switches," the term "pressure switch" herein should be read to include (1) switches that directly make or break a connection by means of direct physical action of pressure on one or more components of the switch, (2) indirect switches through which pressure moves a physical item to make or break the connection, (3) a combination of a pressure sensor and a switch responsive to the state of the sensor, and (4) any other arrangement by which the pressure of a fluid effects the making or breaking of an electrical connection.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should also be understood that the teachings herein may be readily applied to various kinds of lifts. By way of example only, the teachings herein may be readily applied to platform lifts, material lifts, man lifts, etc. The teachings herein may also be readily applied to robotic leg assemblies, adjustable work stations, and shock absorber systems. Various suitable ways in which the teachings herein may be incorporated into such systems and assemblies will be apparent to those of ordinary skill in the art. Similarly, various other kinds of systems and assemblies in which the teachings herein may be incorporated will be apparent to those of ordinary skill in the art.

All publications, prior applications, and other documents cited herein are hereby incorporated by reference in their entirety as if each had been individually incorporated by reference and fully set forth. Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is not to be limited to the details of structure and operation shown and described in the specification and drawings.

What is claimed is:

1. A lift system, comprising:

a first lift unit operated by a first hydraulic actuator;

a second lift unit operated by a second hydraulic actuator;

a hydraulic fluid source;

a first hydraulic line supplying hydraulic fluid from the hydraulic fluid source to the first hydraulic actuator, the first hydraulic line comprising a first pressure sensor configured to detect the pressure of the hydraulic fluid in the first hydraulic line;

a second hydraulic line supplying hydraulic fluid from the hydraulic fluid source to the second hydraulic actuator;

a first switch that, responsive to the first pressure sensor detecting a reduced pressure of the hydraulic fluid in the first hydraulic line, controls the supply of hydraulic fluid to the second hydraulic actuator to cease downward motion of the second lift unit;

an indicator in electrical communication with the first switch; and a second switch electrically connected with the indicator and the first pressure sensor, wherein the second switch is in a normally closed position such that the indicator light is activated when the first pressure sensor senses a first pressure below a predetermined pressure value, and wherein the second switch is configured to transition to an open position such that the indicator light is deactivated in response to detecting a second pressure above the predetermined pressure value.

2. The system of claim 1, wherein the second hydraulic line comprises a second pressure sensor configured to detect the pressure of the hydraulic fluid in the second hydraulic line;

further comprising a second switch that, responsive to the second pressure sensor detecting a reduced pressure of hydraulic fluid in the second hydraulic line, controls the supply of hydraulic fluid to the first hydraulic actuator to cease downward motion of the first lift unit.

3. The system of claim 2, wherein the second switch, responsive to the second pressure sensor detecting a reduced pressure of hydraulic fluid in the second hydraulic line, controls the supply of the hydraulic fluid to the second hydraulic actuator to cease downward motion of the second lift unit.

4. The system of claim 2, wherein the first switch and the second switch are in series with each other.

5. The system of claim 4, further comprising a down button electrically connected in series with the first switch and the second switch.

6. The system of claim 5, further comprising a solenoid valve in electrical communication with the down button.

7. The system of claim 1, wherein the first switch, responsive to the first pressure sensor detecting a reduced pressure of hydraulic fluid in the first hydraulic line, controls the supply of the hydraulic fluid to the first hydraulic actuator to cease downward motion of the first lift unit.

8. The system of claim 1, where the indicator light is electrically connected in parallel with the first switch.

9. The system of claim 8, wherein the second switch is electrically connected in series with the indicator light.

10. The system of claim 1, further comprising a motor in communication with the hydraulic fluid source and the first switch, wherein the motor is configured to change the pressure in the first hydraulic line and the second hydraulic line.

11. The system of claim 10, wherein the motor is configured to generate three-phase power.

12. The system of claim 11, further comprising a transformer and a fuse, each in electrical communication with the first switch.

13. A lift system, comprising:

a first lift unit operated by a first hydraulic actuator;

a second lift unit operated by a second hydraulic actuator;

a hydraulic fluid source;

a first hydraulic line supplying hydraulic fluid from the hydraulic fluid source to the first hydraulic actuator, the first hydraulic line comprising a first pressure sensor configured to detect the pressure of the hydraulic fluid in the first hydraulic line;

a second hydraulic line supplying hydraulic fluid from the hydraulic fluid source to the second hydraulic actuator; and a control assembly configured to actuate the first hydraulic actuator and the second hydraulic actuator in order to raise and lower the first lift unit and the second lift unit, the control assembly comprising:

an up button configured to activate the first hydraulic actuator and the second hydraulic actuator to raise the first lift unit and the second lift unit, a down button configured to activate the first hydraulic actuator and the second hydraulic actuator to lower the first lift unit and the second lift unit, and a first switch in communication with the first pressure sensor and the down button, wherein the first switch is normally open such that the first switch is configured to selectively render the down button inoperable in response to a reduction in the pressure measured by the first pressure sensor, wherein the first switch is configured to close when sufficient pressure is detected in the first hydraulic line, thereby rendering the down button operable.

14. The lift system of claim 13, wherein the down button is electrically connected in series with the first switch.

15. The lift system of claim 14, wherein the up button is electrically connected in parallel with the down button.

16. A lift system, comprising:

a first lift unit operated by a first hydraulic actuator;

a second lift unit operated by a second hydraulic actuator;

a hydraulic fluid source;

a first hydraulic line supplying hydraulic fluid from the hydraulic fluid source to the first hydraulic actuator, the first hydraulic line comprising a first pressure sensor configured to detect a pressure of the hydraulic fluid being supplied by the first hydraulic line;

a second hydraulic line supplying hydraulic fluid from the hydraulic fluid source to the second hydraulic actuator; and a control assembly configured to actuate the first hydraulic actuator and the second hydraulic actuator in order to raise and lower the first lift unit and the second lift unit, the control assembly comprising:

a down button configured to activate the first hydraulic actuator and the second hydraulic actuator to lower the first lift unit and the second lift unit, a first switch in communication with the first pressure sensor and the down button, wherein the first switch is normally open such that the first switch is configured to selectively prevent lowering of the first lift unit and the second lift unit by rendering the down button inoperable in response to a reduction in pressure detected by the first pressure sensor, wherein the first switch is configured to close when sufficient pressure is detected in the first hydraulic line, thereby rendering the down button operable, an indicator light, wherein the indicator light is in electrical communication with the first switch;

a second switch electrically connected with the indicator light and the first pressure sensor, wherein the second switch is in a normally closed position such that the indicator light is activated when the first pressure sensor senses a first pressure below a predetermined pressure value, wherein the second switch is configured to transition to an open position such that the indicator light is deactivated in response to detecting a second pressure above the predetermined pressure value.

* * * * *